US006817907B2

(12) United States Patent
Cheng et al.

(10) Patent No.: US 6,817,907 B2
(45) Date of Patent: Nov. 16, 2004

(54) POWER DISTRIBUTION OUTLET

(76) Inventors: Wen Tsung Cheng, No. 78 Chao-Chou St., Taoyuan (TW); Wen Ho Cheng, No. 78 Chao-Chou St., Taoyuan (TW)

( * ) Notice: Subject to any disclaimer, the term of this patent is extended or adjusted under 35 U.S.C. 154(b) by 0 days.

(21) Appl. No.: 10/424,078

(22) Filed: Apr. 28, 2003

(65) Prior Publication Data

US 2004/0166724 A1 Aug. 26, 2004

(30) Foreign Application Priority Data

Feb. 21, 2003 (TW) ..... 92202779 U

(51) Int. Cl.[7] ..... H01R 4/28; H01R 4/30
(52) U.S. Cl. ..... 439/754; 439/621; 439/755
(58) Field of Search ..... 439/621, 805, 439/957, 763–764, 761, 754–756, 488

(56) References Cited

U.S. PATENT DOCUMENTS 5,171,169 A * 12/1992 Butcher et al. ..... 439/755
5,597,331 A * 1/1997 Gable et al. ..... 439/754
6,162,098 A * 12/2000 Cheng et al. ..... 439/621
6,165,020 A * 12/2000 Cheng et al. ..... 439/621
6,576,838 B2 * 6/2003 Matsumura ..... 174/66

* cited by examiner

*Primary Examiner*—Michael C. Zarroli
(74) *Attorney, Agent, or Firm*—Kao H. Lee

(57) ABSTRACT

A power distribution outlet having a connector body, a distributing block, an insulation plate, a fuse, and an insulation housing is disclosed. The connector body is connected to the electrode of the battery. The distributing block has a plurality of wire inlets for connecting a plurality of power cords. The connector body and the distributing block are fixed on an insulation plate and insulated to each other thereby. The fuse electrically connects the connecting block and the distributing block, which are enclosed in the insulation housing. The above structure allows multiple power cords to be conducted with the battery at the same time, while the fuse can be easily inspected and replaced to protect the electronic products connected to the power cords, and the structure is easily fabricated.

10 Claims, 7 Drawing Sheets

POWER DISTRIBUTION OUTLET

BACKGROUND OF THE INVENTION

The present invention relates to a power distribution outlet and, more particularly, the present invention relates to a power distribution outlet allowing a multiplicity of electronic products to be systematically connected to a car battery. The power distribution outlet has an easily assembled/dissembled fuse providing the convenience and safety for the application of the electronic products.

The typical car is equipped with a variety of power-consuming electronic products, such as the generator, lamp, car stereo and air conditioning system. However, the amount of car batteries providing electricity to the electronic products is limited. When the number of the electronic products is larger than the amount of the car batteries, the electric wiring layout of the power-consuming electric products becomes very crucial. As the new models of cars are continuously developed, in addition to the improvement of performance and safety, comfort level, convenience and added values are also emphasized. Therefore, cars are often promoted with some advanced equipments such as the expensive electronic equipment (for example, the ABS anti-lock breaking system, GPS navigation system and etc.), or high-end video and audio system. Consequently, the amount of required electric wires is increased. However, in the traditional design, the wires are directly connected to the electrode of the car battery via respective ring clips formed on the ends thereof. This causes the inconvenience for individually connecting and disconnecting. Further, the overlapping connection of the electric wires causes great danger. Therefore, the industry has developed some special battery distribution outlet to overcome the problem.

Referring to FIGS. 1 and 2, a conventional power distribution outlet 8 is illustrated. The power distribution outlet 8 comprises a connector body 80 and a connection socket 85. The connector body 80 comprises a clamp portion 81, a wire inlet 82 and a slot 83. The clamp portion 81 includes a bolt 810 for firmly connecting the electrode of a car battery (not shown). More than one wire inlets 82 may be formed to accommodate filaments 90 of power cords 9. The filaments 90 are fixed by the pressing screws 820. The slot 83 is in the shape of a dovetail. The connection socket 85 includes an insulator block 86 and mutually insulated first and second conductor blocks 87 and 88 enclosed in the insulator block 86. The first conductor block 87 comprises a board 870 extending from the insulator 86. The board 870 has a shape matching the dovetail shape of the slot 83, such that the connector body 80 is conducted to the connection socket 85 by engaging the board 870 with the slot 83. Another wire inlet 880 is formed on the second conductor block 88. More than one wire inlets 880 can be formed according to specific requirement for accommodating the filaments 90 of another power cords 9. The power cord 9 is firmly attached by pressing the screw 881 towards the filaments 90. The first and second conductor blocks 87 and 88 further comprise electrode portions 871, 882, respectively, allowing the fuse 89 to be inserted. Thereby, many electric wires can be conducted via the power distribution outlet 8 to deliver electricity, and the electronic products connected by the electric wires are protected by the fuse 89.

However, in the above power distribution outlet 8, the connector body 80 and the connection socket 85 are connected by snapping the board 870 with the slot 83, while the slot 83 and the board 870 are in dovetail shape. The fabrication precision is highly demanded to cause great process difficulty.

According to the above, the conventional power distribution outlet still has inconvenience and drawbacks to be improved.

Therefore, the Applicant has performed researches and tests to develop a design based on the relative theory and years of working experience in this field to improve the inconvenience and drawback of the conventional design.

BRIEF SUMMARY OF THE INVENTION

The present invention provides a power distribution outlet in which a fuse can be easily installed and multiple power cords to be plugged tidily and stably connected to the battery. The power distribution outlet provided visibly inspected fuse could be easily replaced to protect the electronic products. Further, the power distribution outlet is easily for production.

The power distribution outlet provided by the present invention comprises a connector body, a distributing block, an insulation plate, a fuse and an insulation housing. The connector body includes a clip portion, a joining surface, a first electrode portion and a plurality of wire inlets. The clip portion is clamped with the electrode of the battery. The distributing block is a conductor matching to the engaging portion, and has a second electrode portion disposed aligned with and a plurality of wire inlets for receiving power cords. The insulation plate is to fix the connector body and the distributing block into an insulated and single body thereon. The fuse has two conducting parts connected to the first and second electrode portions, respectively. The connector body and distribution block are electrically conducted to each other thereby. The connector body and distribution block are then enclosed by the insulation housing.

BRIEF DESCRIPTION OF THE DRAWINGS

These, as well as other features of the present invention, will become apparent upon reference to the drawings wherein.

DETAILED DESCRIPTION OF THE INVENTION

Figure 1:
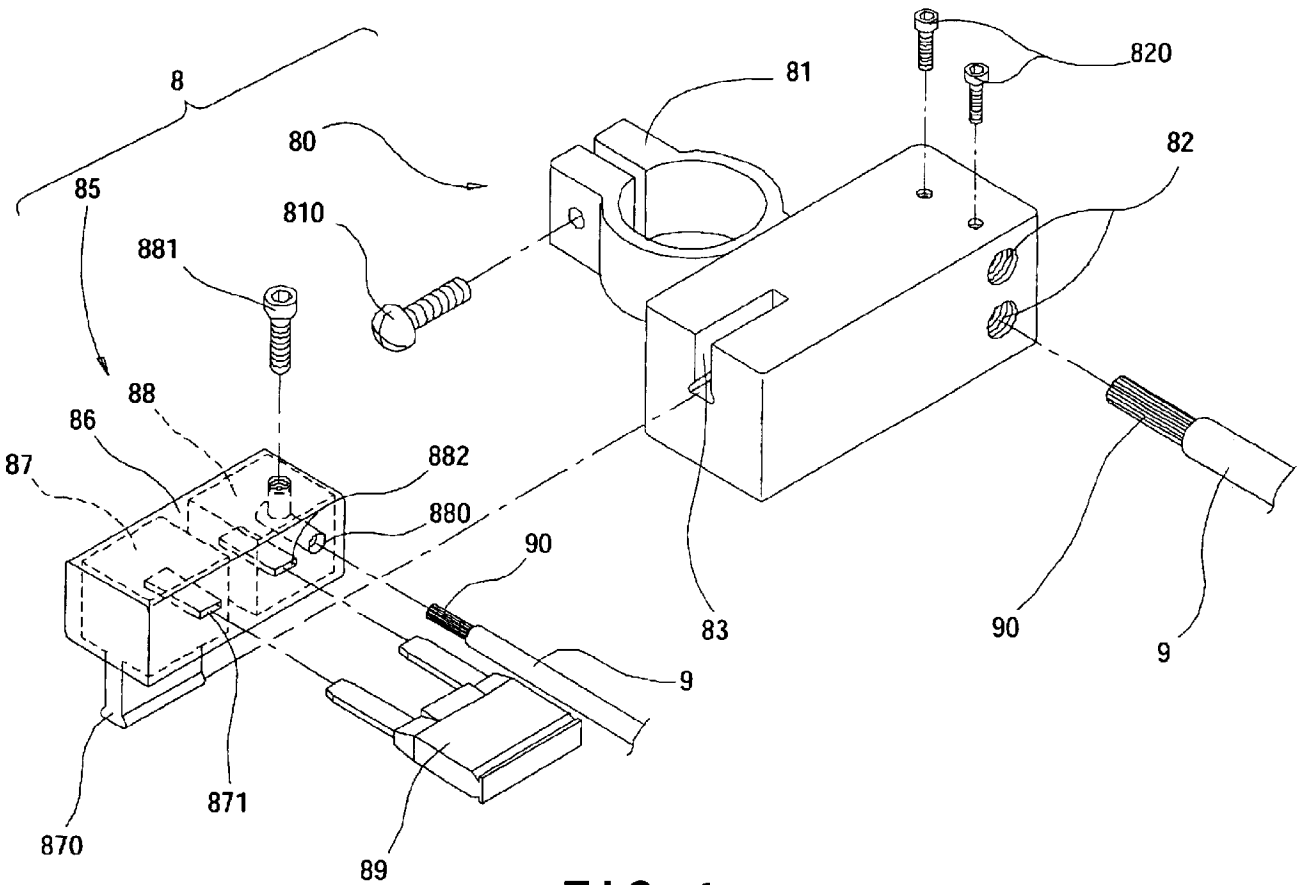
FIG. 1 PRIOR ART
FIG. 1 shows a perspective exploded view of a conventional power distribution outlet.
Figure 2:
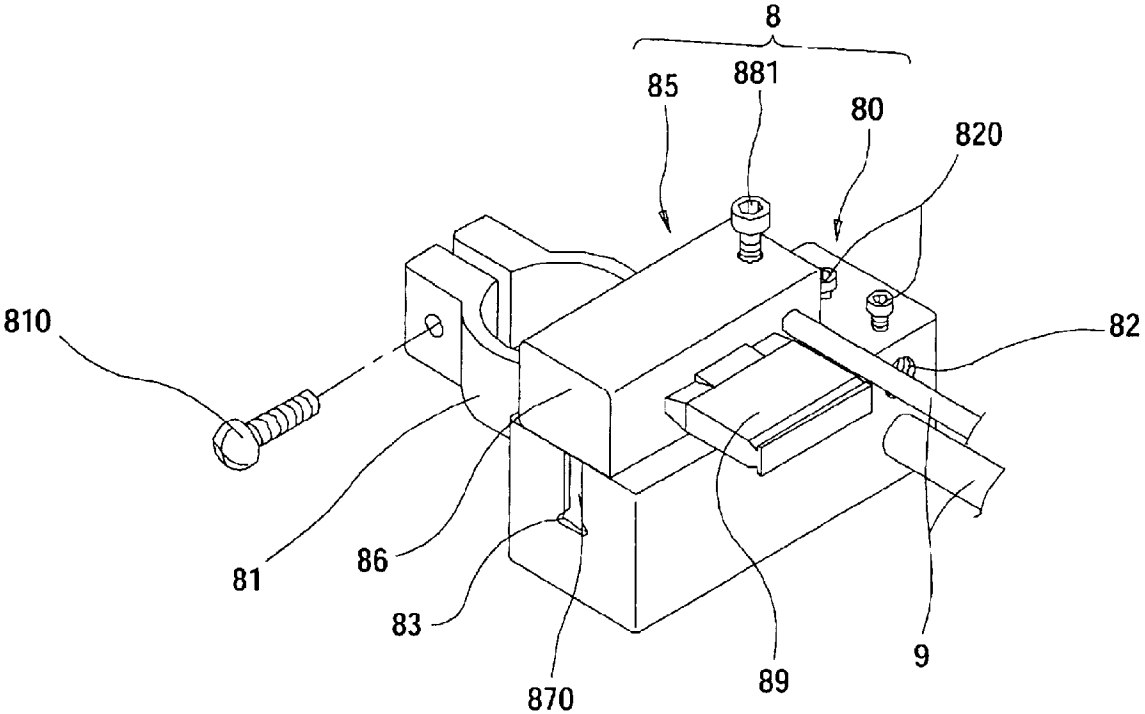
FIG. 2 PRIOR ART
FIG. 2 shows a perspective view of the assembly of the conventional power distribution outlet.
Figure 3:
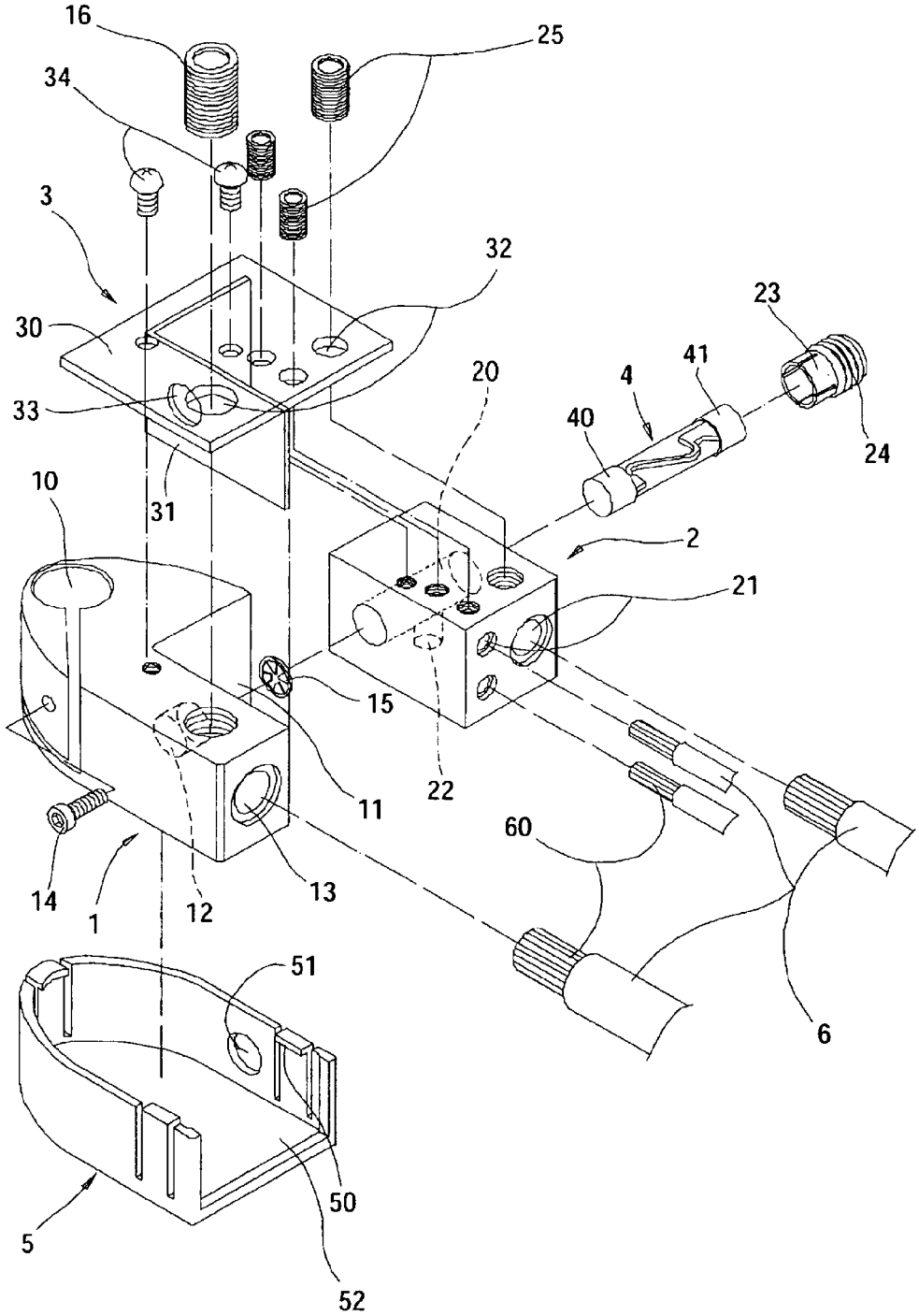
FIG. 3 shows a perspective exploded view of a power distribution outlet provided in a first embodiment of the present invention.
Figure 4:
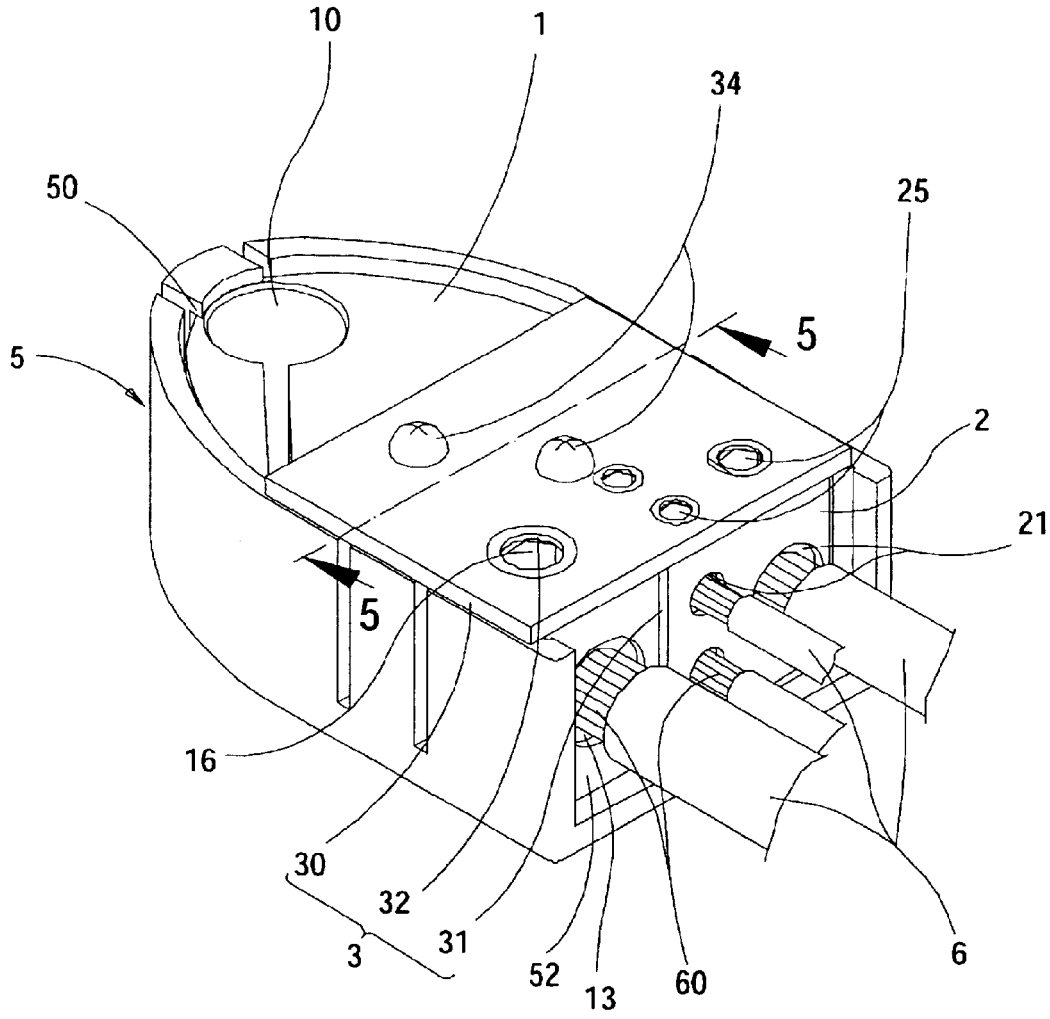
FIG. 4 shows a perspective view of the assembly of the power distribution outlet provided by the present invention.
Figure 5:
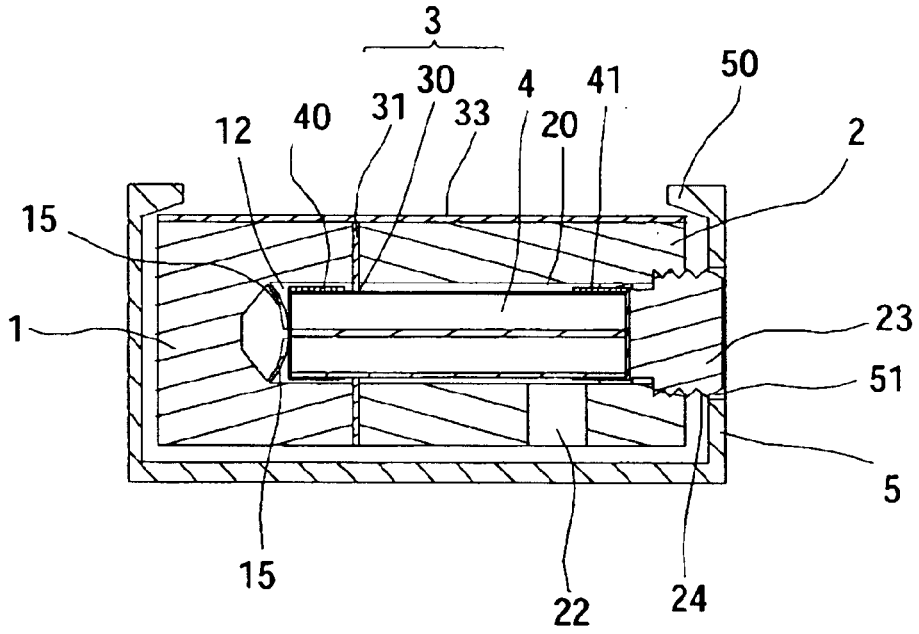
FIG. 5 shows a cross-sectional view along line 5—5 of FIG. 4.

Referring to FIGS. 3 to 5, the present invention provides a power distribution outlet, including a connector body 1, a distributing block 2, an insulation plate 3, a fuse 4 and an insulation housing 5.

The connector body 1 is a conductor and includes a clip portion 10, a joining surface 11, a first electrode portion 12 and a plurality of wire inlets 13. The clip portion 10 includes a bolt 14. The first electrode portion 12 includes a round hole on the joining surface 11 and a splint 15 inside in the hole. Each wire inlet 13 comprises a pressing screw 16.

The distributing block 2 is a conductor and includes a connecting surfaces a second electrode portion 20 and a plurality of wire inlets 21. The connecting surface of the distributing block 2 has a configuration matching the geometry of the joining surface 11 of the connector body 1. The second electrode portion 20 is aligned with the first electrode portion 12, allowing the connector body 1 and the distributing block 2 joining together subsequently. A window 22 is formed below the second electrode portion 20. External to the electrode portion 20*a* terminal cap 23 is installed. The terminal cap 23 is also a conductor with threads 24 formed at a periphery thereof. By the threads 24, the terminal cap 23 is engaged in the second electrode portion 20. The wire inlet 21 includes a pressing screw 25.

The insulation plate 3 includes a base 30 and a sheet 31 extending downwardly from the base 30. The sheet 31 has a structure conformal to the joining surface 11 and the connecting surface of the distributing block 2. A plurality of holes 32 are formed on the base 30 with respect to the pressing screws 16, 25. Further, a hole 33 is formed on the sheet 31 at the position where the first electrode portion 12 is to be disposed.

Two ends of the fuse 4 comprise conducting parts 40, 41, respectively.

The insulation housing 5 includes a plurality of stop blocks 50 at a top edge thereof, a hole 51 at the position wherein the fuse 4 is disposed, and openings 52 at the positions for installing the wire inlets 13 and 21.

The clip portion 10 of the connector body is engaged with the electrode of the battery (not shown) via the bolt 14. The connector body 1 and the distributing block 2 are disposed adjacent to two opposite sides of the sheet 31 and fixed to the base 30 of the insulation plate 3 via screws 34. The fuse 4 is inserted through the second electrode portion 20 to the first electrode portion 12, and then secured in the distributing block 2 and the connector body 1 by threading the terminal cap 23 into the second electrode portion 20. Therefore, the conducting part 40 of the fuse is in contact with the conductive splint 15 of the first electrode portion 12, and the conducting part 41 at the other end thereof is in contact with the terminal cap 23. Thereby, the connector body 1 and the distributing block 2 are electrically conducted via the fuse 4. The insulation housing 5 is then engaged with the base 30 by the stop blocks 50, so as to enclose the connector body 1 and the distributing block 2 therein. The openings 51 and 52 provide convenience of accessing the fuse 4 and plugging the wires 6. The screws 16, 25 pass through the holes 32 of the insulation plate 3 to fixedly press the filaments 60 of the power cords 6.

By the above structure, the power cords 6 can deliver electricity by plugging the filaments 60 thereof into the wire inlets 13, 25 of the connector body 1 and the distributing block 2, respectively, and connecting to the positive electrode of the battery via the terminal cap 23, the conducting parts 40, 41 of the fuse 4, the splint 15 of the connector body 1, and the clip portion 10. When it is suspected that the fuse 4 might be blown or damaged, the user can check from the window 22 of the distributing block 2 aligned under the fuse 4. Therefore, without dissembling the whole structure, the fuse 4 can be inspected and replaced. The user can simply removes the terminal cap 23 from the second electrode portion 20 to replace the fuse 4.

Figure 6:
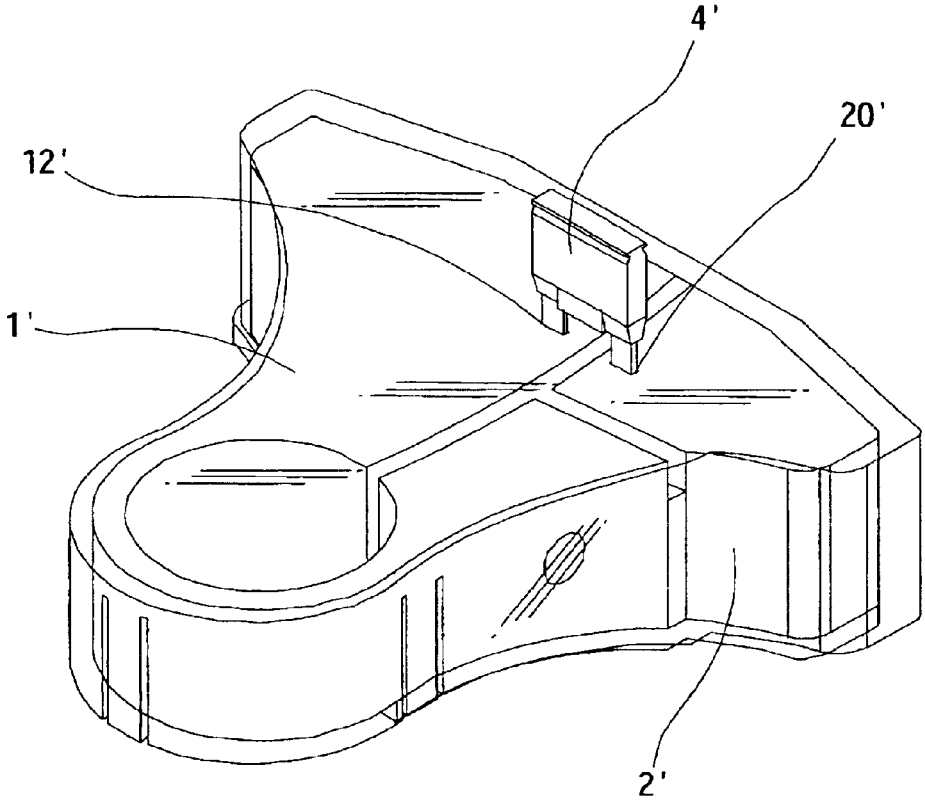
FIG. 6 shows a perspective view of a second embodiment of the power distribution outlet provided by the present invention.

FIG. 6 shows a second embodiment of the present invention, in which the first and second electrode portions 12' and 20' each includes a vertical slot across the connector body 1' and distributing block 2', respectively. Therefore, the fuse 4' can be inserted across the connector body 1 and the distributing block 2.

Figure 7:
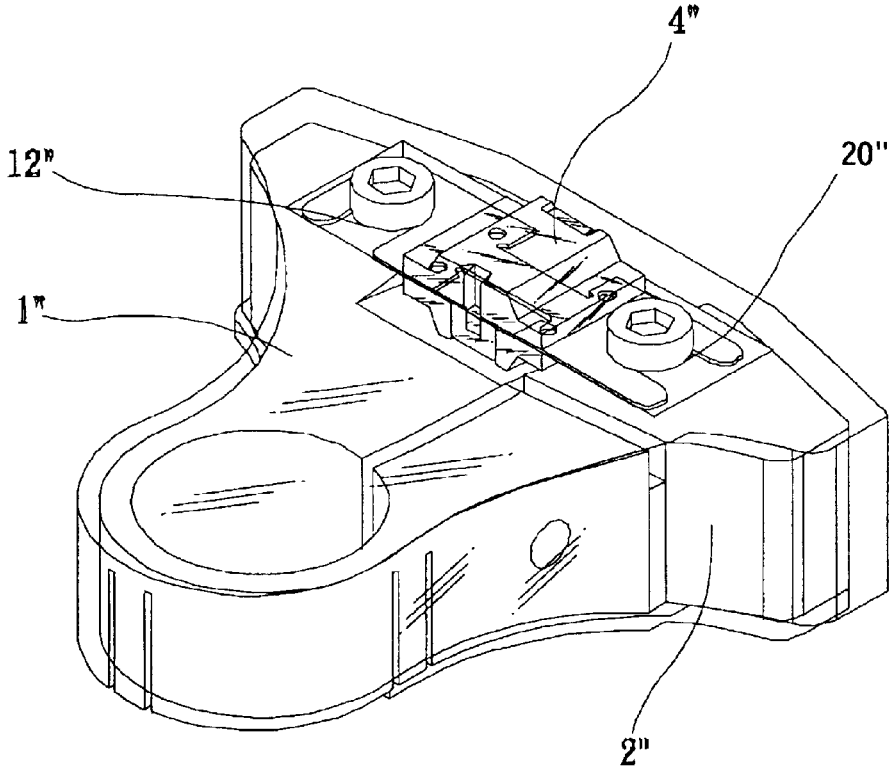
FIG. 7 shows a perspective view of a third embodiment of the power distribution outlet provided by the present invention.

Referring to FIG. 7, a third embodiment of the present invention is illustrated. The first electrode portion 12" and the second electrode portion 20" each includes a threaded hole, allowing the fuse 4" to be threaded through the connector body 1" and the distributing block 2", so as to provide the conduction therebetween.

Accordingly, the power distribution outlet provided by the present invention does not only provide the connection of a multiplicity of power cords to the car battery, but also properly arrange the power cords to suppress the hazard of unwanted connection and overlap between the power cords. In addition, the fuse is easily inspected and replaced to control the magnitude of electricity, such that the expensive electronic products can be protected. Further, the fabrication includes simply process such as drilling, threading to install the fuse for conducting the connecting block and the distributing block. Therefore, the fabrication is effectively simplified compared to the fabrication of the dovetail slot and board.

This disclosure provides exemplary embodiments of a child safety blind. The scope of this disclosure is not limited by these exemplary embodiments. Numerous variations, whether explicitly provided for by the specification or implied by the specification, such as variations in shape, structure, dimension, type of material or manufacturing process may be implemented by one of skill in the art in view of this disclosure.

What is claimed:

1. A power, distribution outlet, to connect an electrode of a battery to a plurality of power cords, comprising:

a connector body, having a clip portion, a joining surface, a first electrode portion and at least one wire inlet, wherein the clip portion is used to connect the electrode of the battery, and the wire inlets is used to receive one of the power cords;

a distributing block, having a connecting surface, a second electrode portion and a plurality of wire inlets, wherein the connecting surface is conformal to the joining surface, the second electrode portion is aligned with the first electrode portion, and the wire inlets of the distributing block are used to receive other one of the power cords;

an insulation plate, to fix the connector body and the distributing block into a single body thereon, so as to insulate the connector body from the distributing block;

a fuse, having two conductive parts coupled to the connector body and the distributing block respectively, so as to conduct the connector body with the distributing block; and an insulation housing, to enclose the connector body and the distribution block therein.

2. The power distribution outlet according to claim 1, wherein the insulation plate includes a base and a sheet extending upwardly from the base, the sheet is conformal to the joining surface and a distributing surface, such that the connector body and the distributing block are fixed adjacent to two opposite sides of the sheet on the base.

3. The power distribution outlet according to claim 2, wherein the connector body and the distributing block are fixed on the base via a plurality of screws.

4. The power distribution outlet according to claim 2, wherein each of the wire inlets communicates with a corresponding screw hole having a pressing screw, and a respective hole is formed in the base of the insulation plate.

5. The power distribution outlet according to claim 1, wherein the first electrode portion includes a circular hole formed through the joining surface and a conductive splint installed therein, and the second electrode portion includes a slot penetrating through the distributing block and aligned with the circular hole, such that the first and second electrode portions are merged into a single hole allowing the fuse inserted there through, and the second electrode portion further comprising a terminal cap, the terminal cap is a conductor, such that the connector body and the distributing block is conducted via the fuse, the terminal cap and the conductive splint.

6. The power distribution outlet according to claim 5, wherein the distribution block further comprises a window aligned over the second electrode portion.

7. The power distribution outlet according to claim 1, wherein the insulation housing comprises a plurality of stop blocks at a bottom edge thereof to snap with the insulation plate, so as to enclose the connector body and the distributing block therein.

8. The power distribution outlet according to claim 1, wherein the insulation housing further comprises an opening at a position where the fuse is inserted in the distribution block, and an opening at a position wherein the power cords are plugged in.

9. The power distribution outlet according to claim 1, wherein the first and second electrode portions include slots allowing the fuse to plug in, so as to electrically connect the connector body and the distributing block.

10. The power distribution outlet according to claim 1, wherein the first and second electrode portions include threaded holes allowing the fuse to be threaded in, so as to electrically connect the connector bode and the distributing block.

* * * * *